United States Patent [19]

Tegtmeyer

[11] Patent Number: 4,941,404

[45] Date of Patent: Jul. 17, 1990

[54] SCREW PRESS

[75] Inventor: Kurt Tegtmeyer, Salzgitter, Fed. Rep. of Germany

[73] Assignee: Salzgitter Maschinenbau GmbH, Salzgitter, Fed. Rep. of Germany

[21] Appl. No.: 272,895

[22] PCT Filed: Nov. 4, 1987

[86] PCT No.: PCT/EP87/00671

§ 371 Date: Aug. 11, 1988

§ 102(e) Date: Aug. 11, 1988

[87] PCT Pub. No.: WO88/04989

PCT Pub. Date: Jul. 14, 1988

[30] Foreign Application Priority Data

Jan. 2, 1987 [DE] Fed. Rep. of Germany ..... 3700016

[51] Int. Cl.[5] ..... B30B 3/02

[52] U.S. Cl. ..... 100/117; 100/127; 100/131; 100/145; 100/150

[58] Field of Search ..... 100/116, 110, 117, 127, 100/131, 145, 146, 147, 148, 149, 150

[56] References Cited

U.S. PATENT DOCUMENTS 3,998,148 12/1976 Mainka et al. ..... 100/117
4,530,761 7/1985 Koch et al. ..... 100/117 X

FOREIGN PATENT DOCUMENTS 963230 2/1957 Fed. Rep. of Germany .
1846103 2/1962 Fed. Rep. of Germany .
3125653 1/1983 Fed. Rep. of Germany .
56-105897 8/1981 Japan ..... 100/117

*Primary Examiner*—Frankie L. Stinson
*Attorney, Agent, or Firm*—Michael J. Striker

[57] ABSTRACT

A screw press comprises a housing having a spray casing and a screen casing arranged within the spray casing and forming an annular space therebetween, at least one press spindle located within the screen casing and forming a pressing space therebetween, the at least one press spindle having a plurality of wing members and at least one axial zone free of the wing members, and at least one dewatering member which is supported by the housing and located in the at least one axial zone in the pressing space between the spindle body and the screen casing, the at least one dewatering member being hollow and provided with a plurality of perforations and also having an outlet which opens into the annular space between the screen casing and the spray casing, the at least one dewatering member being arranged at a radial distance from the spindle and the screen casing, and at least one carrier holding the at least one dewatering member.

13 Claims, 7 Drawing Sheets

FIG. 4
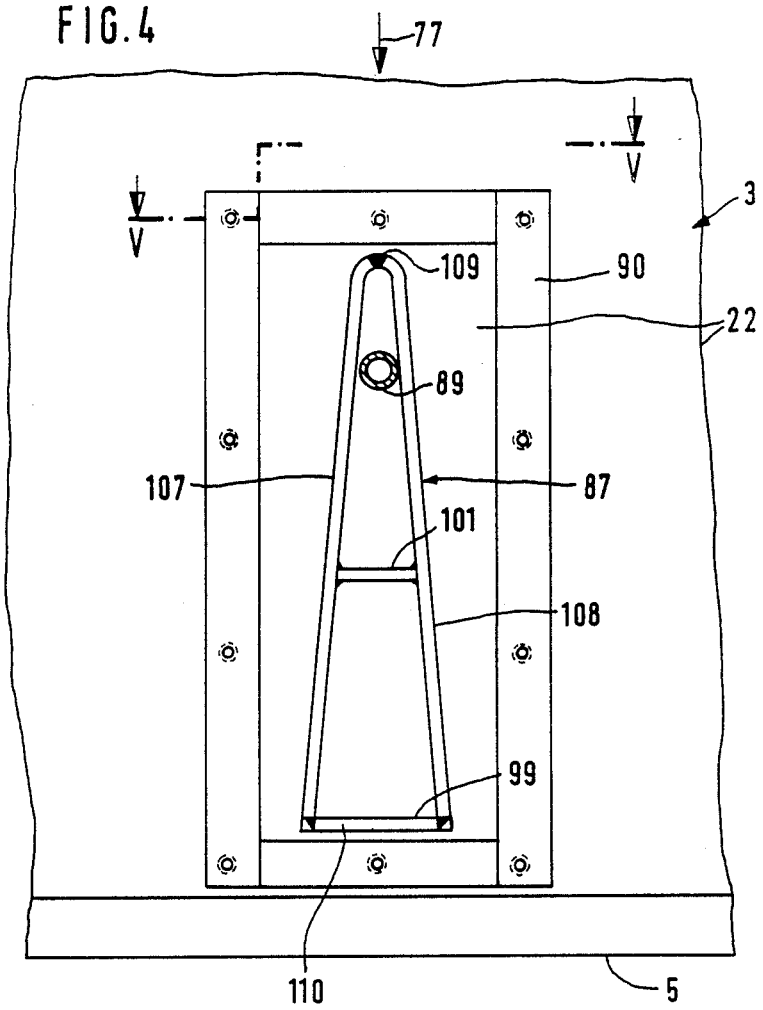
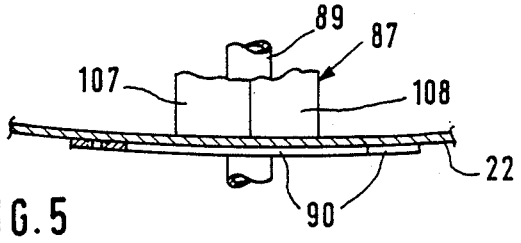
FIG. 5

FIG.8
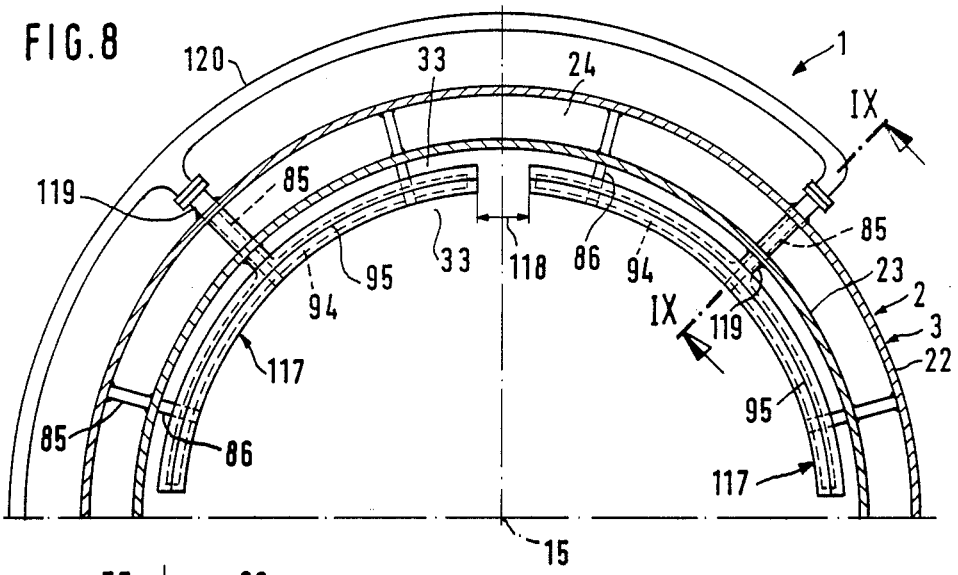
FIG.9
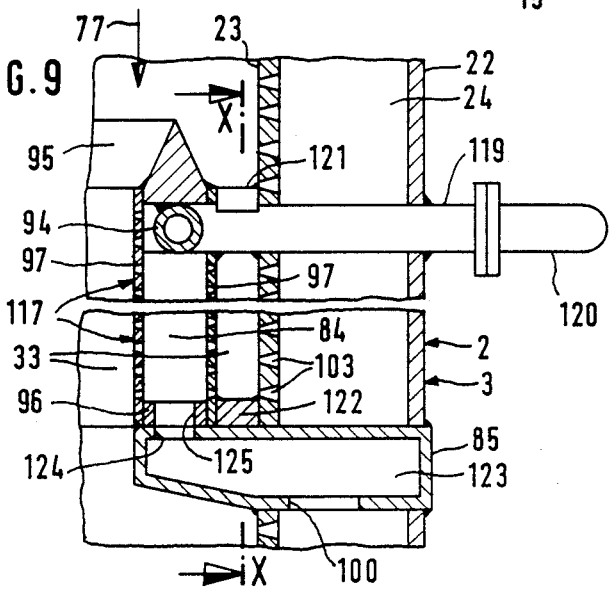
FIG.10
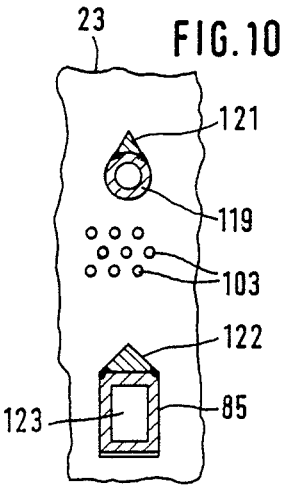
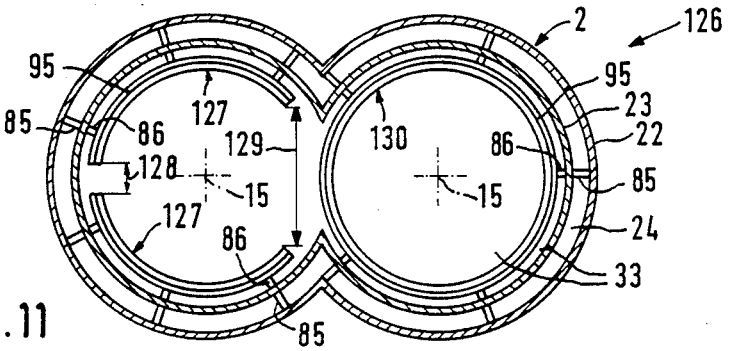
FIG.11

SCREW PRESS

BACKGROUND OF THE INVENTION

The invention relates to a screw-type spindle press. More particularly, it relates to a screw type spindle press which has a housing including a spray casing and a screen casing defining an annular space therebetween, a press spindle rotatable in said housing within said screen casing so as to form a pressing space therebetween and provided with a plurality of wing members, and at least one axial zone which is free of the wing members, and at least one hollow perforated dewatering member which is provided in the above mentioned axial zone in the pressing space between the spindle and the screen casing and having an outlet in the annular space between the screen casing and the spray casing.

In a known pulp press of this type (DE-OS 31 25 653) the dewatering members, which are similar to the interruptors, are fastened directly at the housing, so that their hollow space is partly defined by means of the screen shell. Accordingly, dewatering surfaces are lost on the screen wall on the one hand and at the dewatering members on the other hand.

In another known pulp press of this type (DE Utility Model 1 846 103) interruptors are arranged in the axial zones between adjacent worm wings, which interruptors are guided through openings in the spray shell and the screen shell from the outside and are fastened at the spray shell. A hollow spindle body of the press spindle is perforated along its entire length for conducting the press fluid out of the pulp press cake.

The worm wings and the interruptors are provided with screen surfaces and with ducts for conducting out the press fluid. Details of the construction of the interruptors are not disclosed. It is disadvantageous that the length of the interruptors and, accordingly, their open cross-sectional surface area of flow-off decreases in a transporting direction of the pulp press.

Half-moon-shaped interruptors which are swivelable around their longitudinal axis are known, per se, from DE-PS 963 230; the pointed edge of these interruptors can be directed against the pulp flow. Every interruptor has a hollow space which communicates with the first annular space or pressing room via a series of nozzles in a rear wall of the interruptor. The nozzles serve to feed heat into the pressing room, particularly by means of steam for heating the pulp press when starting. The nozzles are also supposed to be suitable for conducting away the pressed out fluid. However, this appears to be ruled out, since the nozzles lie in an expansion area of the interruptor which decreases in cross-sectional surface area and in which the adjacent pressed pulp expands, that is, they release no fluid, but, on the contrary, suck it in.

SUMMARY OF THE INVENTION

The invention has the object of increasing the output.

In keeping with these objects and with others which will become apparent hereinafter, one feature of the present invention resides, briefly stated in a screw press of the above mentioned general type in which the dewatering member or every one of the dewatering members is arranged at a radial distance from the spindle and the screen casing and is held by at least one carrier. The longitudinal axis of the screw press can be arranged so as to be vertical (upright) or horizontal (so as to lie) or can occupy any intermediate inclined position. With a circular cylindrical housing, the cross-sectional surface area of the spindle body preferably increases from the inlet side to the outlet side. Likewise, the pitch of the worm wings on the spindle body preferably decreases from the inlet side to the outlet side and the spindle body is hollow and perforated. As a rule, interruptors are fastened at the housing between adjacent worm wings so as to be distributed in a transverse plane and extend into the pressing room until the vicinity of the spindle body to the extent that this is allowed by the dewatering members. The radial distance of every dewatering member from the spindle body can be equal to its radial distance from the screen shell. The dewatering members preferably come to a point against the arriving material to be pressed. Accordingly, the division of the material flow along the dewatering member into material layers is facilitated. A considerable additional dewatering surface is provided by every dewatering member with respect to the material to be pressed which brushes past them. This is located in the interior of the material flow in the pressing room, that is, in a material zone which could otherwise only be insufficiently dewatered. The arrangement of the dewatering members thus contributes considerably to increasing the dry substance in the pressed material and to increasing the output of the screw press and, moreover, allows an effective removal of gas from the material to be pressed. The carrier can come to a point against the arriving material to be pressed in order to divide the material more easily in this manner and guide it around the carrier.

A particularly large additional dewatering surface can be provided if the dewatering member extends around the entire circumference of the press spindle. For this purpose the inner wall and the outer wall of every dewatering member can be formed as a circular cylindrical wall provided with a plurality of perforations and arranged concentrically to the longitudinal axis of the screw press or its press spindle.

In accordance with another feature of the present invention, a plurality of dewatering members can be arranged in every axial zone at a circumferential distance from one another, and an inner wall and an outer wall of every dewatering member can be formed as a segment of a circular cylinder provided with a plurality of perforations and arranged concentrically to the longitudinal axis of the screw press or its press spindle. In this construction axial webs of the material to be pressed remain between the dewatering members in the circumferential direction. These webs possess a certain shearing resistance and, in this way, act like interruptors which prevent the material to be pressed from rotating along with the press spindle.

It is still another feature of the present invention, that the outlet of the dewatering member can be integrated in the carrier. This feature is advantageous in terms of a simple construction. A plurality of carriers can be arranged at an axial distance from one another at every dewatering member. With this feature, unwanted deflecting movements of the dewatering members and their operating stresses are prevented.

A further feature of the present invention is that at least one rinsing line can be introduced into the dewatering member. The rinsing line can be connected with a rinsing fluid source by a connection line which is guided through the housing. Thereby the hollow space of each dewatering member can be cleaned in a simple manner. This can be effected, for example, with fresh water at a pressure of 3 to 6 bar when there is the risk that the perforations of the dewatering member will be impeded because of deposits or, e.g. stoppages with fibrous materials such as pulp.

The connection line of the above mentioned rinsing means can be formed as one of the carriers. This construction is structurally simple, wherein the carrier can again come to a point against the arriving material to be pressed.

The outlet of the dewatering member and the above mentioned connection line can be integrated together into one of the carriers. This construction also provides constructional advantages, wherein the carrier can again come to a point against the arriving material to be pressed.

Every dewatering member can be provided with a plurality of spacers located between its opposite walls. With this construction the distance between the opposite walls can also be maintained by simple means even under the external influence of pressure by means of the material to be pressed.

The housing of the screw press of the invention can be provided with a plurality of interruptors located radially outside of the dewatering member and introduced into the pressing space. These features can be used when there is the risk of the material to be pressed rotating along with the press spindle in the area of the dewatering members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 4 shows the view, according to line IV—IV in FIG. 3, in a slightly reduced view, FIG. 5 shows the view, according to line V—V in FIG. 4, partly in section, FIG. 8 shows a sectional view of another screw press corresponding in part to FIG. 2, FIG. 9 shows the sectional view, according to line IX—IX in FIG. 8, in an enlarged view, FIG. 10 shows the sectional view, according to line X—X in FIG. 9, and FIG. 11 shows a sectional view, corresponding in part to FIG. 8, through another embodiment form, constructed as a double-screw press, again without press spindles.

DESCRIPTION OF THE PREFERRED EMBODIMENTS

Figure 1:
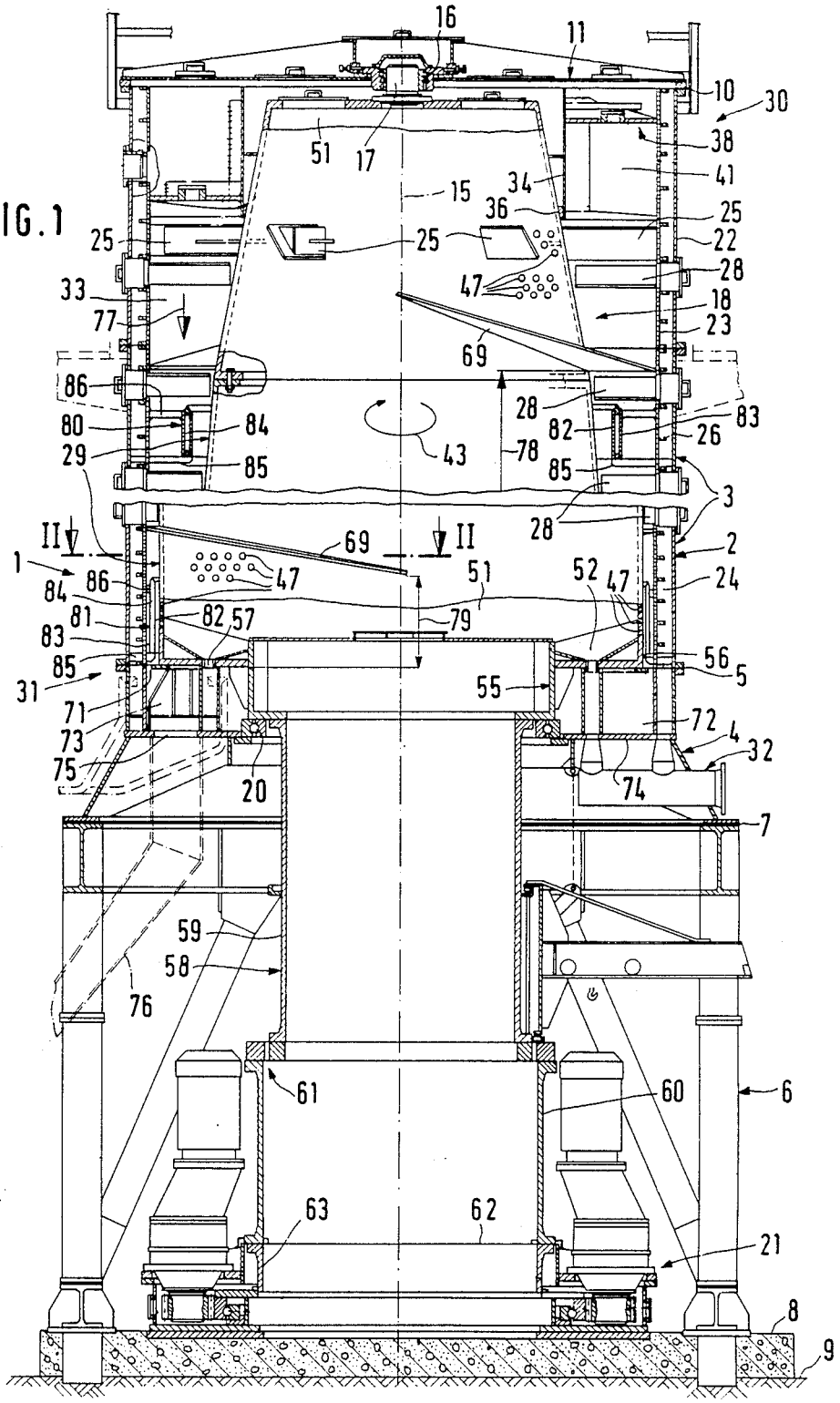
FIG. 1 shows a longitudinal section through a screw press which is arranged so as to be vertically upright and is constructed as a pulp press, the longitudinal section being bent at the longitudinal axis by 90°.

In FIG. 1, a screw press 1, which is constructed as a pulp press, comprises a housing 2 with a circular cylindrical upper portion 3 and a lower portion 4 which are screwed with one another along a plane 5. The lower portion 4 rests on an upright frame 6 so as to be fixed against rotation relative to it and is screwed with it along a plane 7. The upright frame 6 is fastened at a foundation 8 which rests on a floor 9.

A cover 11 is screwed with the upper portion 3 along a plane 10. The cover 11 carries an upper bearing 16 which is adjustable with respect to a longitudinal axis 15 of the screw press 1, a shaft end 17 of a press spindle 18 being supported in the bearing 16 so as to be rotatable.

In addition, the press spindle 18 is supported in a lower bearing 20 of the lower portion 4 so as to be rotatable in a rotating direction 43 and is drivable so as to rotate by means of a drive arrangement 21 arranged at the bottom in the upright frame 6.

The upper portion 3 of the housing 2 comprises a spray shell 22, which is divided into axially consecutive courses, and a screen shell 23 which is arranged inside the spray shell 22 and is likewise divided into axially consecutive courses. An annular space 24 for guiding away fluid which is pressed out of the sugar beet pulp and passes outward through the screen shell 23 through screen holes, not shown in FIG. 1, is provided between the spray shell 22 and the screen shell 23. The screen shell 23 is provided with such screen holes from the compressor blades 25 of a spindle body 29 until the plane 5 (see FIGS. 3, 7, 9 and 10). Interruptors 28, which extend radially inward until the vicinity of the spindle body 29 of the press spindle 18, are inserted from the outside in receiving openings of the upper portion 3 in a plurality of vertical planes. The radial extent of the interruptors 28 decreases from the top to the bottom in the same way that the cross-sectional surface area of the spindle body 29 increases from an upper inlet side 30 of the spindle press 1 to its lower outlet side 31. The annular space 24 is connected with a dewatering arrangement 32 in the lower portion 4. There is a pressing room 33 between the screen shell 23 and the spindle body 29.

The pressing room 33 is defined at the top by means of a helically constructed front wall 38 which is welded on the outside with the screen shell 23 so as to be tight and is welded on the inside with an annular wall 34 so as to be likewise tight, the annular wall 34 being sealed relative to the spindle body 29 with an annular seal 36. The upper portion 3 comprises a rectangular filling opening 41 through which wet pulp is fed into the pressing room 33 by means of a horizontally and tangentially arranged tamping worm, not shown.

The spindle body 29 is also provided with perforations 47 only downward from the compressor blades 25 for the passage of pressed out fluid.

The spindle body 29 comprises a hollow space 51 into which the perforations 47 allow pressed out fluid to pass through. The hollow space 51 communicates with the dewatering arrangement 32.

A base connection piece 55 of the spindle body 29 is connected with an inner ring of the lower bearing and with a telescoping drive pipe 58 which extends downward. An upper pipe 59 and a lower pipe 60 of the drive pipe 58 are connected with one another by means of a toothed coupling 61. The lower pipe 60 is screwed with a drive connection piece 63 of the drive arrangement 21 along a plane 62.

The spindle body 29 carries worm wings 69 which extend outwardly, at least approximately in contact with the screen shell 23, and whose pitch and axial distance from one another decrease from the inlet side 30 to the outlet side 31. After leaving an outlet annular gap 71, the pressed pulp falls into an annular space 72 of the lower portion 4 in which clearing wings 73 rotate. Diametrically opposed fall-out openings 75 are arranged in an annular plate 74 of the lower portion 4 and, in each instance, deliver the pressed pulp to a fall shaft 76.

The material to be pressed is moved by means of the press spindle 18 in a transporting direction 77 from the inlet side 30 to the outlet side 31. On this path, the material to be pressed constantly gives off fluid into the annular space 24 of the housing 2, on the one hand, and into the hollow space 51 of the spindle body 29 on the other hand. The layers of the material to be pressed which are adjacent to the screen shell 23 and the spindle body 29 are dewatered very favorably in this manner. The extent of the dewatering decreases from these bordering layers toward the center of the material to be pressed. In this center, it is particularly difficult for the fluid and gases to reach the screen shell 23 or the spindle body 29 because of the increasingly compressed material.

For this reason, dewatering members 80 and 81 are provided in axial zones 78 and 79 between adjacent worm wings 69 and between the lowest worm wing 69 and the plane 5 in the pressing room 33. The worm wing of the press spindle 18 which defines the axial zone 78 at the bottom in FIG. 1 is not shown because of the break line.

Every dewatering member 80, 81 is constructed so as to be circular cylindrical and is arranged at a radial distance from the spindle body 29 as well as from the screen shell 23. Every dewatering member 80, 81 therefore divides the flow of the material to be pressed arriving in the transporting direction 77 into an inner and and outer partial flow with reference to the longitudinal axis 15. These partial flows deliver fluid and gases to a hollow space 84 of the dewatering members 80, 81 through perforations in an inner wall 82 and an outer wall 83 of the dewatering members 80, 81. These fluid and gases are guided away into the annular space 24 of the housing 2 in a manner to be described below.

Every dewatering member 80, 81 is supported by means of a quantity of carriers 85 of the housing 2 which are distributed along the circumference and extend inward. Radial carriers 86, which are fastened at the screen shell 23 and stabilize the dewatering member 80, 81 in its operating position, are also provided at the dewatering members 80, 81 at the top.

Figure 2:
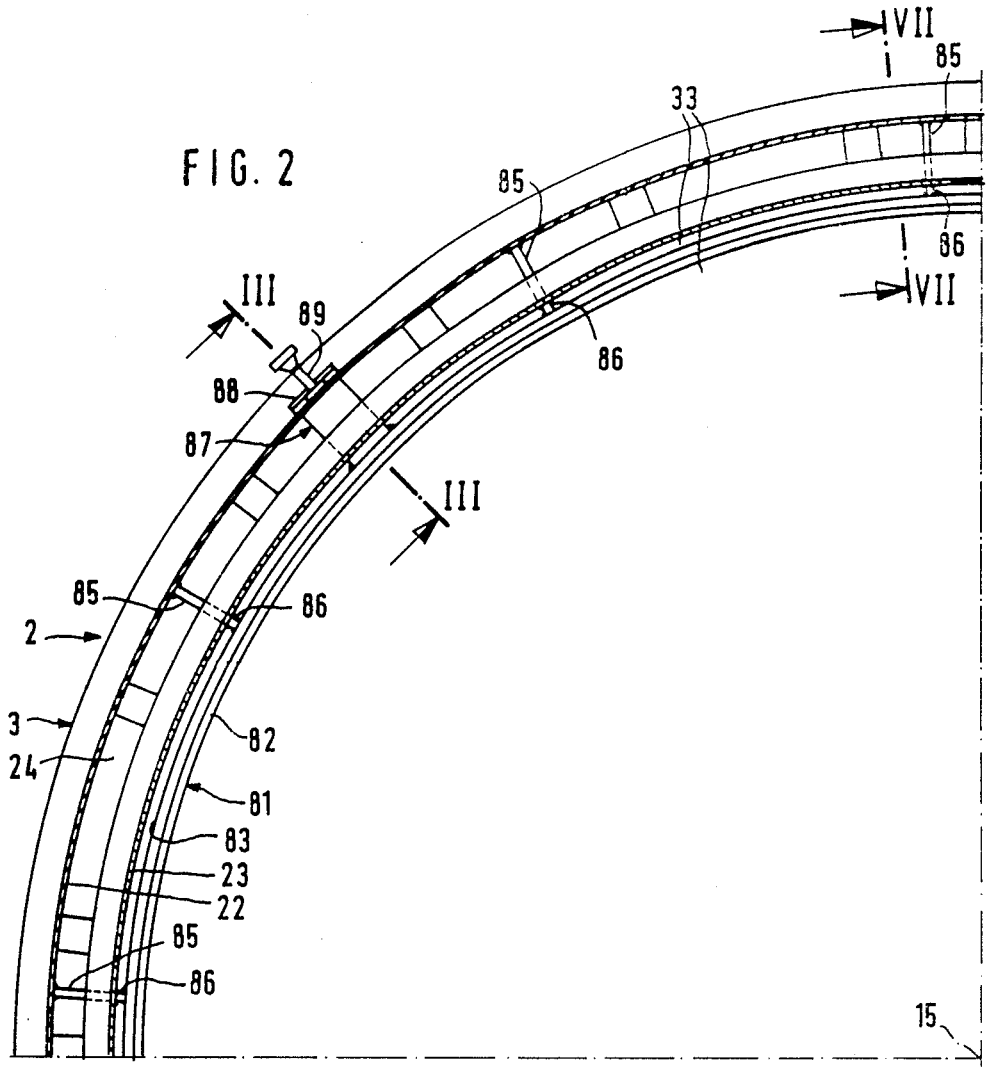
FIG. 2 shows a part of the sectional view, according to line II—II in FIG. 1, in an enlarged view and without press spindle.

According to FIG. 2, every carrier 86 is welded in between the screen shell 23 and the outer wall 83 of the dewatering member 81. Every carrier 85 which is arranged lower than the carrier 86 is welded with the outer wall 83 on the one hand and with the screen shell 23 and an inner surface of the spray shell 22 on the other hand.

In addition, FIG. 2 shows a special carrier 87. The carrier 87 has a relatively larger cross-sectional surface area and serves to guide pressed out fluid and gases out of the dewatering member 81 into the annular space 24 in a manner to be described later. A plurality of such carriers 87 can also be distributed along the circumference of the housing 2.

The carrier 87 comprises an inspection glass 88 on the outside. In addition, a connection line 89, which is connected at the outside to a rinsing fluid source, not shown, is guided through the carrier 87.

Figure 3:
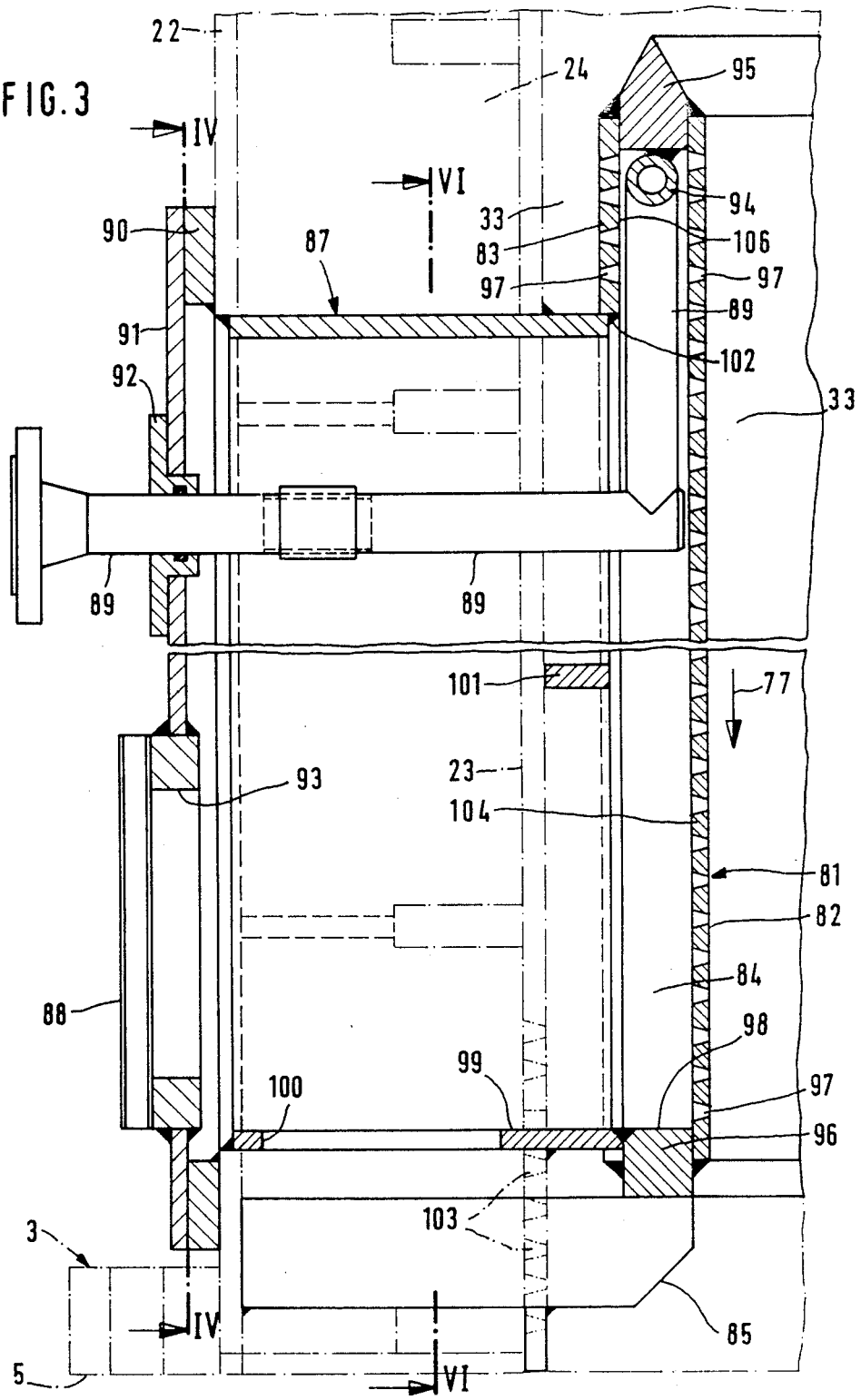
FIG. 3 shows the sectional view, according to line III—III in FIG. 2, in an enlarged view.

In FIG. 3, the portions of the upper portion 3 shown here are shown in a dash-dot line for the sake of clarity. The carrier 87 comprises an assembly flange 90 outside the spray shell 22, a front panel 91, which is bent in a circular cylindrical manner, being screwed with the assembly flange 90 so as to be tight. A guide bush 92 is inserted in an opening of the front panel 91 and receives an outer end of the connection line 89. Below the guide bush 92, another opening 93 in the front panel 91 is closed by means of the inspection glass 88 so as to be tight.

The connection line 89 is guided through the carrier 87 in an inward direction until the hollow space 84 and is guided upward from there in an angled manner until a rinsing line 94. The rinsing line 94 is welded with a head rail 95 of the dewatering member 81, which head rail 95 comes to a point at the top against the transporting direction 77, and extends along the entire circumference of the circular cylindrical dewatering member 81.

The inner wall 82 and the outer wall 83 of the dewatering member 81 are respectively welded at the top with the head rail and at the bottom with a base rail 96 so as to be tight and are provided in each instance with perforations 97 which admit pressed out fluid and gases into the hollow space 84. The base rail 96 is supported on the lower carriers 85. An upper surface 98 of the base rail 96 has a downward slope within the hollow space 84 of 1%, for example, until the special carrier 87. In FIG. 3, the base rail 96 reaches its lowest point so that its upper surface 98 is aligned in the horizontal direction with an upper base surface 99 of the hollow carrier 87. The base surface 99 comprises an outlet 100 which opens into the annular space 24. A crosspiece 101 is welded in the carrier 87 within the screen shell 23 for the purpose of reinforcement.

The operation is as follows: the material to be pressed migrates in the transporting direction 77 and is split by means of the dewatering member 81 into two circular cylindrical layers, one of which is advanced between the screen shell 23 and the outer wall 83, while the other is advanced between the inner wall 82 and the spindle body, which is not shown in FIG. 3. Fluid and gases are removed from these circular cylindrical layers, both on the inside and on the outside. The fluid, which possibly enters the hollow space 84 with a proportion of fibrous materials, e.g. pulp, flows downward therein until the sloped upper surface 98 of the base rail 96. The fluid and the fibrous or solid materials which are possibly contained therein flow along the upper surface 98 until the special carrier 87, there being at least one of the latter, which special carrier 87 is welded with an outlet opening 102 of the outer wall 83 so as to be tight. The fluid or mixture then flows along the base surface 99 through the outlet 100 into the annular space 24, which also guides away those pressed out fluid and gases which have entered through the holes 103 in the screen shell 23.

The operator can observe an inner surface 104 of the inner wall 82 through the inspection glass 88 and the interior of the carrier 87 and can determine whether or not the perforations 97, which can be seen there, are impeded with fibrous materials, for example, such as pulp. If such an impediment or stoppage of the perforations 97 is observed, a fluid which is under pressure, e.g. fresh water with a pressure of 3 to 6 bar, is injected through the connection line 89 and sprayed out of the nozzle heads 105 (FIG. 7) along the length of the rinsing line 94 onto the inner surface 104 and an opposite inner surface 106 of the outer wall 83. There can also be a continuous spraying in this manner.

FIG. 4 shows that the special carrier 87 comprises side walls 107 and 108, which run together opposite the transporting direction 77 in the manner of a roof and are connected with one another at their apex by means of a weld seam 109 so as to be tight. On the outside, the side walls 107, 108 are welded into a complementary opening of the spray shell 22 and are welded with one another at the bottom by means of a base 110 so as to be tight. The substantially rectangular assembly flange 90 is, in turn, welded on at the outside at the spray shell 22 and is bent in a circular cylindrical shape so as to complement the spray shell 22 according to FIG. 5.

Figure 6:
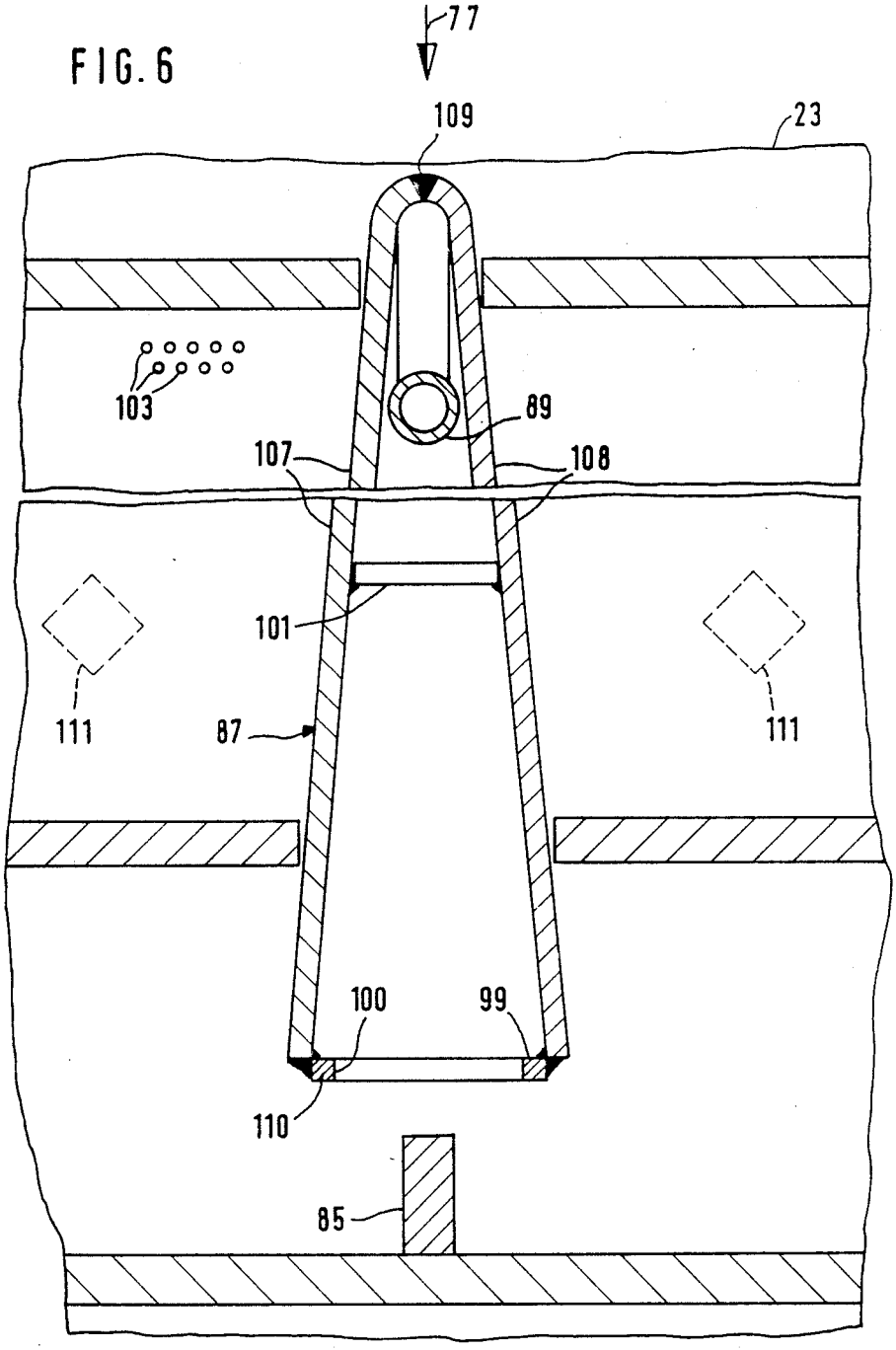
FIG. 6 shows the sectional view, according to line VI—VI in FIG. 3.

FIG. 6 shows details of the special carrier 87. In addition, spacers 111 are indicated in dashed lines in FIG. 6, which are square in cross section and are arranged in various axial planes between the inner surfaces 104, 106, according to FIG. 7.

Figure 7:
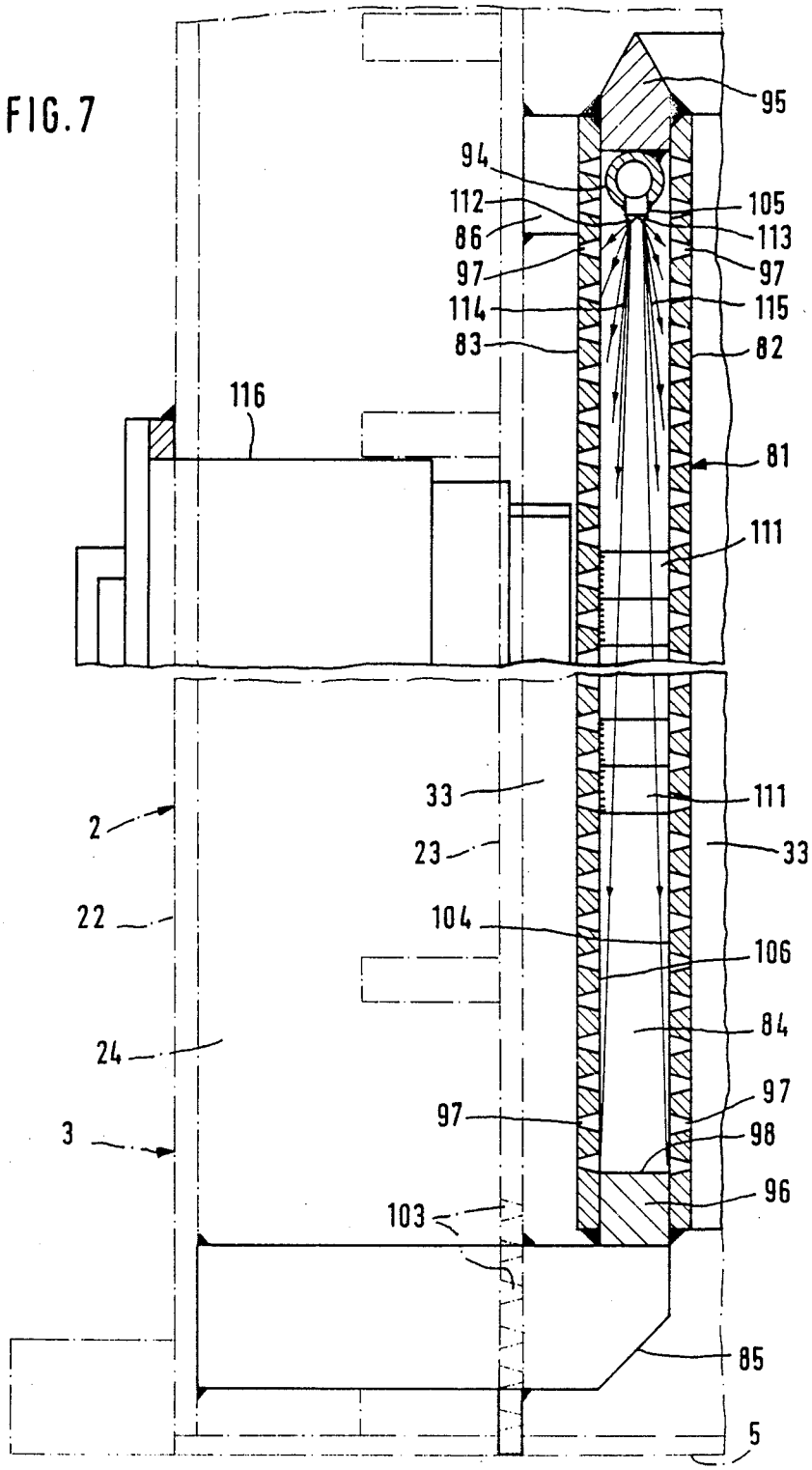
FIG. 7 shows the sectional view, according to line VII—VII in FIG. 2, in an enlarged view.

As shown in FIG. 7, the spacers 111 are welded on at the inner surface 106. The spacers 111 are distributed in the hollow space 84 in such a way that the walls 82, 83 of the dewatering member 81 are effectively prevented from being bent into the hollow space 84 by the material to be pressed which brushes past on the outside.

According to FIG. 7, every nozzle head 105 arranged along the rinsing line 94 comprises two nozzles 112 and 113 which are arranged adjacent to one another in the radial direction and which spray the rinsing fluid in a spray cone 114 and 115 respectively on the entire inner surface 104, 106. It can also be seen in FIG. 7 that the upper surface 98 of the base rail 96 is higher relative to the walls 82, 83 than in FIG. 3. The previously mentioned downward slope accordingly occurs, which causes fibrous and solid material portions in the pressed out fluid to float out of the hollow space 84.

In addition, according to FIG. 7, an interruptor 116 is inserted into the housing 2 from the outside, the interruptor 116 extending through the screen shell 23 into the pressing room 33 until the vicinity of the outer wall 83. Such interruptors 116 are not required as a rule, since the material to be pressed is prevented from rotating along with the press spindle 18 by means of its friction at the screen shell 23 and the walls 82 and 83. If there is a risk of such a rotation in a particular case, the required quantity of interruptors 116 can be installed along the circumference of the housing 2, possibly in a plurality of axial planes.

In all of the drawings, identical parts are provided with the same reference numbers.

FIG. 8 shows only one half of the housing 2 of the screw press 1. The other half, which is not shown, is constructed in an analogous manner. In the half according to FIG. 8, two dewatering members 117 are provided at a distance from one another in the circumferential direction. In the area of the circumferential distance 118, the material to be pressed is thus not divided by means of the dewatering members 117 but, rather, is transported in practice as a web of material parallel to the longitudinal axis 15. These material webs, which are distributed along the circumference, assume the function of interruptors insofar as they prevent or impede the material from rotating along with the press spindle, not shown in FIG. 8.

Rinsing fluid is fed to the rinsing line 94 of each dewatering member 117 by means of a connection line 119 which simultaneously takes over the function of an upper carrier corresponding to the carriers 86. All connection lines 119 are connected to a rinsing fluid source 120 designed as an external annular line which, for example, guides fresh water at 3 to 6 bar.

According to FIG. 9, a roof 121, which comes to a point opposite the transporting direction 77, is welded on at the top to the connection line 119 in the area of the pressing room 33, which roof 121 facilitates the division of the material flow. A similar roof 122 is welded on in the area of the pressing room 33 at the top on the lower carrier 85. The carrier 85 is constructed in its entirety so as to be hollow with an interior space 123. The interior space 123 continuously communicates with the annular space 24 via the outlet 100 on the one hand and with the hollow space 84 via an inlet 124 and a perforation 125 in the base rail 96 on the other hand, which perforation 125 is flush with the inlet 124.

FIG. 10 particularly shows the construction of the roofs 121, 122 and the interior space 123.

FIG. 11 shows the housing 2 of a double-screw press 126 in a schematic manner, the two press spindles of the double-screw press 126 are not drawn in order to simplify the drawing.

In the left-hand part of the housing 2, according to FIG. 11, two dewatering members 127 are provided which have unequal circumferential distances 128 and 129 from one another. According to FIG. 11, on the other hand, only one rotating dewatering member 130 is mounted in the right-hand part of the housing 2. The dewatering members 127 can also be advanced more closely to the dewatering members 130 or, in the limiting case, can also be constructed as a continuous dewatering member according to the dewatering member 130. Two continuous dewatering members 130 would then contact one another.

In principle, dewatering members corresponding to the embodiment examples described above can be installed in the pressing room of all known single- or multiple-spindle screw presses. In every case, the dewatering action and the output of the screw press are considerably improved.

It will be understood that each of the elements described above, or two or more together, may also find a useful application in other types of constructions differing from the types described above.

While the invention has been illustrated and described as embodied in a screw press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A screw press, comprising a housing having a spray casing and a screen casing arranged within said spray casing and forming an annular space therebetween; at least one press spindle located within said screen casing and forming a pressing space therebetween, said at least one press spindle having a plurality of wing members and at least one axial zone free of said wing members; and at least one dewatering member which is supported by said housing and located in said at least one axial zone in said pressing space between said spindle body and said screen casing, said at least one dewatering member being hollow and provided with a plurality of perforations and also having an outlet which opens into said annular space between said screen casing and said spray casing, said at least one dewatering member being arranged at a radial distance from said spindle and said screen casing; and at least one carrier holding said at least one dewatering member.

2. A screw press as defined in claim 1; and further comprising at least one second such dewatering member arranged at a radial distance from said spindle and said screen casing, and at least one second such carrier holding said second dewatering member.

3. A screw press as defined in claim 1, wherein said outlet of said dewatering member is integrated in said carrier.

4. A screw press as defined in claim 1; comprising a plurality of such carriers, said at least one dewatering member being held by said plurality of carriers, and said carriers being arranged at an axial distance from one another.

5. A screw press as defined in claim 1; and further comprising means for rinsing said at least one dewatering member and including at least one rinsing line introduced into said dewatering member.

6. A screw press as defined in claim 5, wherein said rinsing means further includes a rinsing fluid source and a connection line extending through said housing and connecting said rinsing fluid source with said rinsing line.

7. A screw press as defined in claim 6, wherein said outlet and said connection line are integrated in said carrier.

8. A screw press as defined in claim 1, wherein said at least one dewatering member has opposite walls and a plurality of spacers provided between said opposite walls.

9. A screw press as defined in claim 8, wherein said press spindle has a further axial zone which is free of said wing members; and further comprising at least two further such dewatering members arranged in said further axial zone at a circumferential distance from one another and each having an inner wall and an outer wall each formed as a segment of a circular cylinder provided with a plurality of perforations, said segments of said further dewatering members being concentric to said longitudinal axis of said spindle.

10. A screw press as defined in claim 1; and further comprising a plurality of interruptors which are mounted on said housing radially outside of said at least one dewatering member and introduced into said pressing space.

11. A screw press, comprising a housing having a spray casing and a screen casing arranged within said spray casing and forming an annular space therebetween; at least one press spindle located within said screen casing and forming a pressing space therebetween, said at least one press spindle having a plurality of wing members and at least one axial zone free of said wing members; and at least one dewatering member which is supported by said housing and located in said at least one axial zone in said pressing space between said spindle body and said screen casing, said at least one dewatering member being hollow and provided with a plurality of perforations and also having an outlet which opens into said annular space between said screen casing and said spray casing, said at least one dewatering member being arranged at a radial distance from said spindle and said screen casing; and at least one carrier holding said at least one dewatering member, said spindle having a longitudinal axis, said dewatering member having an inner wall and an outer wall formed as circular cylindrical walls each provided with a plurality of perforations, said circular cylindrical walls being concentric to said longitudinal axis of said spindle.

12. A screw press, comprising a housing having a spray casing and a screen casing arranged within said spray casing and forming an annular space therebetween; at least one press spindle located within said screen casing and forming a pressing space therebetween, said at least one press spindle having a plurality of wing members and at least one axial zone free of said wing members; and at least one dewatering member which is supported by said housing and located in said at least one axial zone in said pressing space between said spindle body and said screen casing, said at least one dewatering member being hollow and provided with a plurality of perforations and also having an outlet which opens into said annular space between said screen casing and said spray casing, said at least one dewatering member being arranged at a radial distance from said spindle and said screen casing; and at least one carrier holding said at least one dewatering member, said spindle having a longitudinal axis, said dewatering members being located at a circumferential distance from one another and each having an inner wall and an outer wall each formed as a segment of a circular cylinder provided with a plurality of perforations, said segments being concentric to said longitudinal axis of said spindle.

13. A screw press, comprising a housing having a spray casing and a screen casing arranged within said spray casing and forming an annular space therebetween; at least one press spindle located within said screen casing and forming a pressing space therebetween, said at least one press spindle having a plurality of wing members and at least one axial zone free of said wing members; and at least one dewatering member which is supported by said housing and located in said at least one axial zone in said pressing space between said spindle body and said screen casing, said at least one dewatering member being hollow and provided with a plurality of perforations and also having an outlet which opens into said annular space between said screen casing and said spray casing, said at least one dewatering member being arranged at a radial distance from said spindle and said screen casing; and at least one carrier holding said at least one dewatering member; means for rinsing said at least one dewatering member and including at least one rinsing line introduced into said dewatering member, said rinsing means also including a rinsing fluid source and a connection line extending through said housing and connecting said rinsing fluid source with said rinsing line, said connection line being formed as said carrier.

* * * * *